US011616318B2

(12) United States Patent
Yamamoto

(10) Patent No.: US 11,616,318 B2
(45) Date of Patent: Mar. 28, 2023

(54) ELECTRICAL CONNECTION COMPONENT

(71) Applicant: YAZAKI CORPORATION, Tokyo (JP)

(72) Inventor: Hirotaka Yamamoto, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/204,850

(22) Filed: Mar. 17, 2021

(65) Prior Publication Data

US 2021/0296809 A1 Sep. 23, 2021

(30) Foreign Application Priority Data

Mar. 18, 2020 (JP) ..... JP2020-048292

(51) Int. Cl.
*H01R 13/41* (2006.01)
*H01R 9/22* (2006.01)

(52) U.S. Cl.
CPC ..... *H01R 13/41* (2013.01); *H01R 9/223* (2013.01)

(58) Field of Classification Search
CPC ..... H01R 11/12; H01R 2105/00; H01R 4/34; H01R 43/20; H01R 12/716; H01R 13/04; H01R 13/405; H01R 13/41; H01R 13/502; H01R 13/516; H01R 13/52; H01R 13/5202; H01R 13/521; H01R 13/6215; H01R 13/6397; H01R 13/6581; H01R 13/6598; H01R 2201/26; H01R 4/30; H01R 4/302; H01R 4/308; H01R 43/005; H01R 9/223; H01R 9/24; H01R 9/2416
See application file for complete search history.

(56) References Cited

U.S. PATENT DOCUMENTS

| | | | | |
|---|---|---|---|---|
| 7,811,116 | B2 * | 10/2010 | Sakakura | H01R 11/12 439/364 |
| 9,484,647 | B2 * | 11/2016 | Ishikawa | H01R 9/24 |
| 9,490,564 | B2 * | 11/2016 | Nakayama | H01R 43/20 |
| 9,570,899 | B2 * | 2/2017 | Tanaka | H02G 15/013 |
| 9,601,863 | B2 * | 3/2017 | Takemura | H01R 13/5202 |
| 10,062,974 | B2 * | 8/2018 | Okamoto | H01R 13/6581 |
| 10,468,792 | B2 * | 11/2019 | Yamamoto | H01R 9/2416 |
| 11,139,606 | B2 * | 10/2021 | Nito | H01R 13/426 |
| 11,189,955 | B2 * | 11/2021 | Aoki | H01R 13/521 |

FOREIGN PATENT DOCUMENTS

| | | | |
|---|---|---|---|
| JP | S55-26806 | U | 2/1980 |
| JP | H02-7763 | U | 1/1990 |
| JP | 2011-176928 | A | 9/2011 |
| JP | 2012-134007 | A | 7/2012 |

* cited by examiner

*Primary Examiner* — Vanessa Girardi
(74) *Attorney, Agent, or Firm* — Kenealy Vaidya LLP

(57) ABSTRACT

An electrical connection component includes a conductor, and a housing into which the conductor is press-fitted. The housing includes a press-fitted portion having a hollow shape and into which the conductor is press-fitted in a press-fitting direction, and a restriction portion provided at a position different from a position of the press-fitted portion, the restriction portion restricting at least a part of the conductor from being displaced in a direction different from the press-fitting direction from a time point when press-fitting of the conductor into the press-fitted portion is started to a time point when the press-fitting is completed.

6 Claims, 7 Drawing Sheets

ELECTRICAL CONNECTION COMPONENT

CROSS REFERENCE TO RELATED APPLICATIONS

This application is based on Japanese Patent Application No. 2020-048292 filed on Mar. 18, 2020, the contents of which are incorporated herein by reference.

BACKGROUND OF THE INVENTION

1. Field of the Invention

The present disclosure relates to an electrical connection component in which a conductor is press-fitted into a housing.

2. Description of the Related Art

In related art, an electrical connection component in which a conductor such as a bus bar is fixed to a resin housing has been proposed. This type of electrical connection component can be used, for example, as a so-called terminal block for providing a power circuit for a vehicle or the like. For example, one of the related-art electrical connection components includes a resin housing and a metal bus bar fixed to the housing (for example, see JP-A-2011-176928).

When the bus bar is fixed to the housing, a part of the bus bar may be press-fitted into a through hole or the like provided in the housing. When such press-fitting is performed, if a direction of an external force for press-fitting applied to the bus bar is not appropriate, unintended deformation such as bending of the bus bar may occur. Such deformation is due to a positional displacement of the bus bar from an original attachment position, for example, when an external terminal is attached to the bus bar (for example, bolt fastening or the like is performed) after press-fitting, which may cause a decrease in workability of attachment work. In addition, the same deformation may occur when a conductor other than the bus bar is press-fitted into the housing. For this reason, it is desirable to prevent the unintended deformation of the conductor press-fitted into the housing as much as possible.

SUMMARY OF THE INVENTION

An object of the present disclosure is to provide an electrical connection component capable of preventing deformation of a conductor when the conductor is attached to a housing by being press-fitted.

In order to achieve the above object, the present disclosure provides an electrical connection component including a conductor; and a housing into which the conductor is press-fitted, in which the housing includes a press-fitted portion having a hollow shape and into which the conductor is press-fitted in a press-fitting direction; and a restriction portion provided at a position different from a position of the press-fitted portion, the restriction portion restricting at least a part of the conductor from being displaced in a direction different from the press-fitting direction from a time point when press-fitting of the conductor into the press-fitted portion is started to a time point when the press-fitting is completed.

As described above, according to the present disclosure, it is possible to provide an electrical connection component capable of preventing deformation of a conductor when the conductor is attached to a housing by being press-fitted.

The present disclosure has been briefly described above. Further, details of the present disclosure will be further clarified by reading through embodiments for carrying out the present disclosure described below with reference to the accompanying drawings.

DESCRIPTION OF EMBODIMENTS

Embodiment

Figure 1:
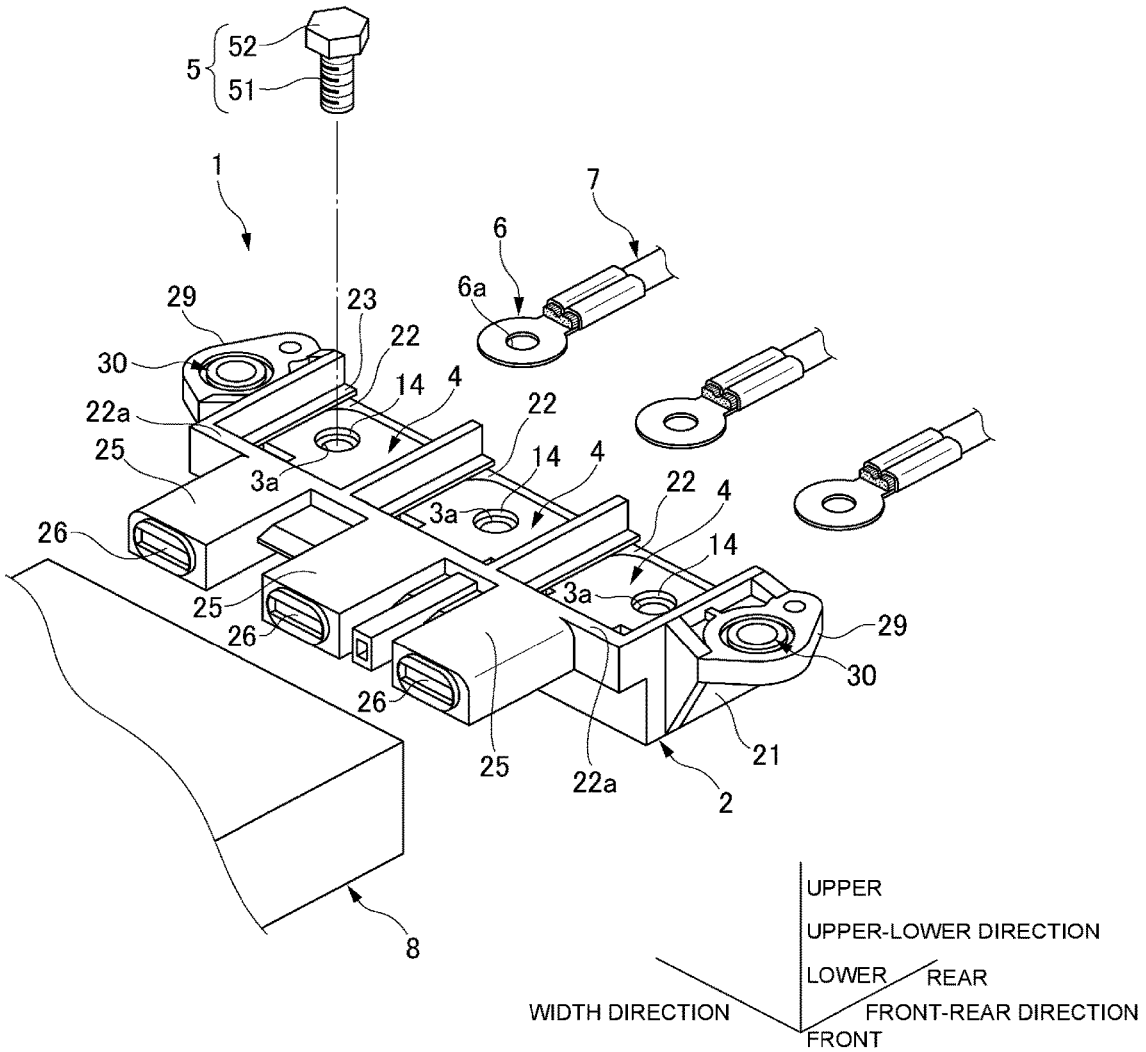
FIG. 1 is a perspective view showing an electrical connection component, a plurality of terminals respectively provided at ends of a plurality of electric wires, and a mating connector, according to an embodiment of the present disclosure.

Hereinafter, an electrical connection component 1 according to an embodiment of the present disclosure will be described with reference to the drawings. As will be described later, an electrical connection component 1 shown in FIG. 1 is used as a relay connector in which a terminal 6 is fixed and conducted to a predetermined circuit, and is generally referred to as a terminal block. Therefore, the electrical connection component 1 is also referred to as a "terminal block 1" below. The terminal block 1 is typically mounted on a vehicle and used to form a power supply system circuit. The terminal block 1 is configured to electrically connect a plurality of terminals 6 respectively provided at ends of a plurality of electric wires 7 extending from various electrical components (not shown) and a mating connector 8 via bus bars 4. The terminal 6 is a so-called eyeglass terminal having a circular flat plate shape, and a through hole **6*a* penetrating in a plate thickness direction is formed in a central portion of the terminal 6**.

Hereinafter, as shown in FIGS. 1 to 7, a "front-rear direction", a "width direction", an "upper-lower direction", "front", "rear", "upper" and "lower" are defined for convenience of description. The "front-rear direction", the "width direction" and the "upper-lower direction" are orthogonal to each other. The front-rear direction coincides with a mating direction of the terminal block 1 and the mating connector 8.

As shown in FIGS. 1 to 5, the terminal block 1 includes a resin housing 2, a plurality of metal nuts 3 press-fitted into a plurality of press-fitting grooves 27 (see FIGS. 3 and 4) provided in the housing 2, a plurality of metal bus bars 4 accommodated in a plurality of bus bar accommodation portions 22 (see FIGS. 1 to 3 and 5) provided in the housing 2. Hereinafter, components constituting the terminal block 1 will be described in order.

Figure 2:
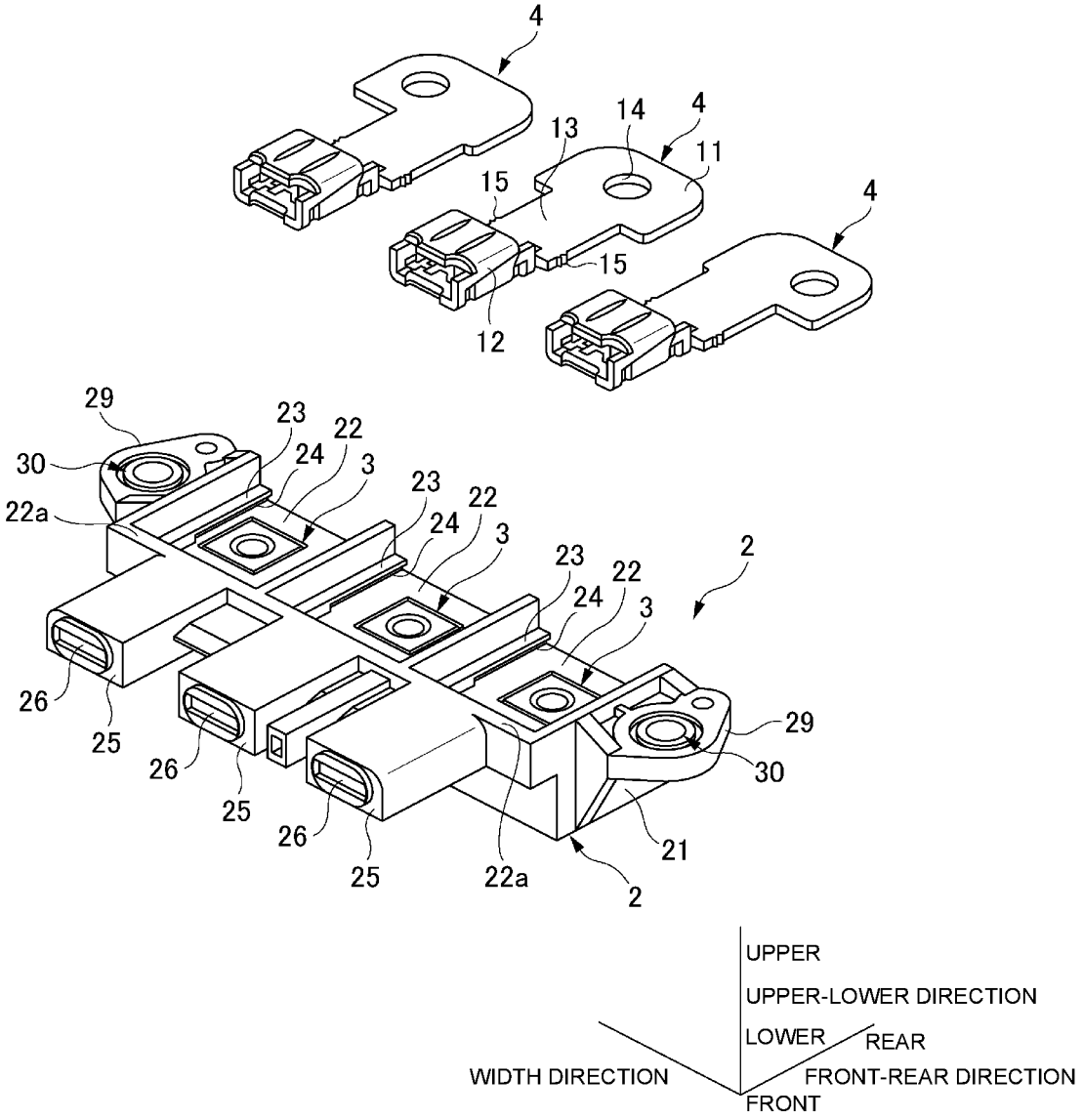
FIG. 2 is a perspective view of the electrical connection component shown in FIG. 1 in a state in which bus bars are separated from a housing.
Figure 3:
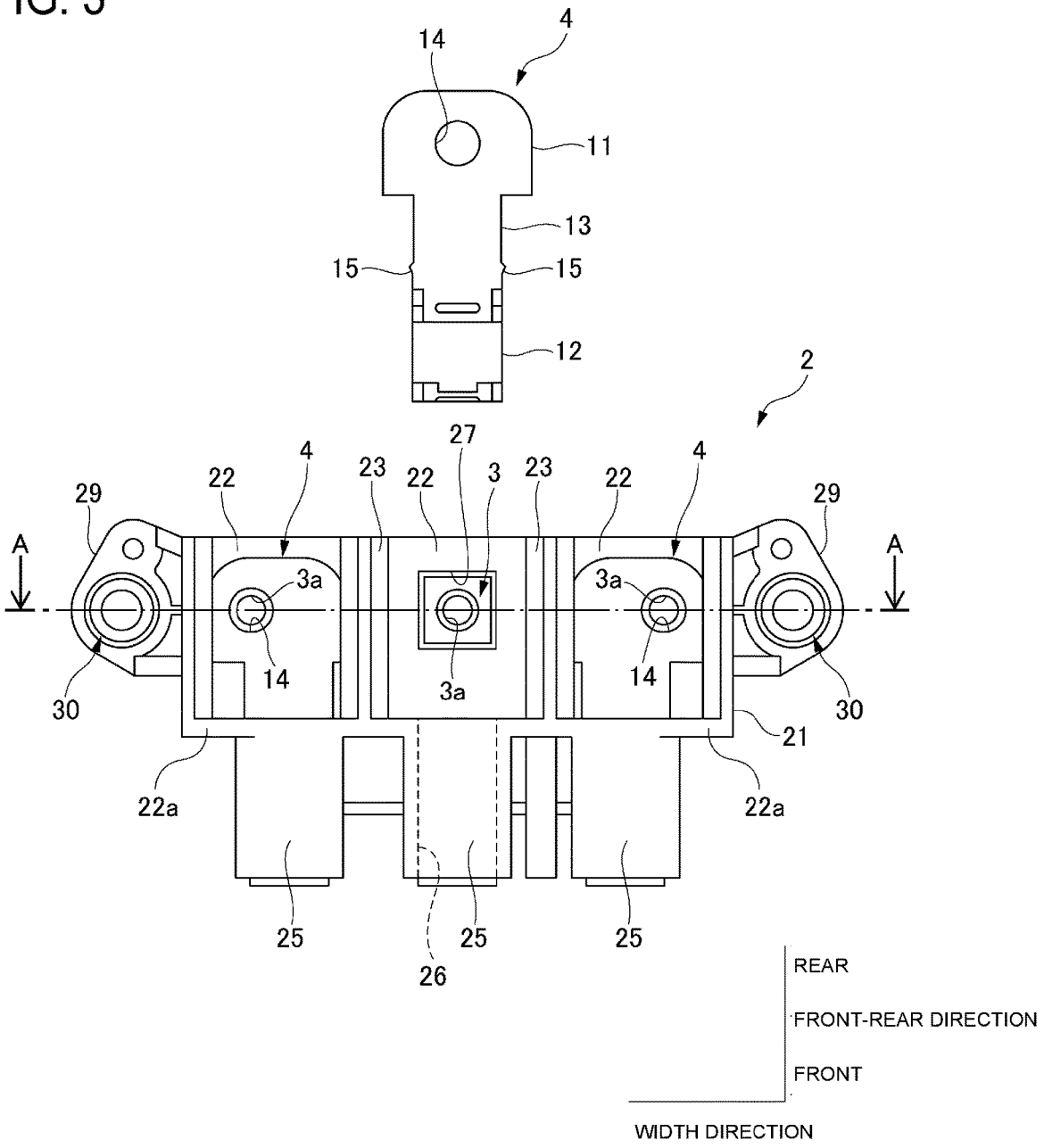
FIG. 3 is a top view of the electrical connection component shown in FIG. 1 (one of the plurality of bus bars is shifted in order to show a nut).
Figure 5:
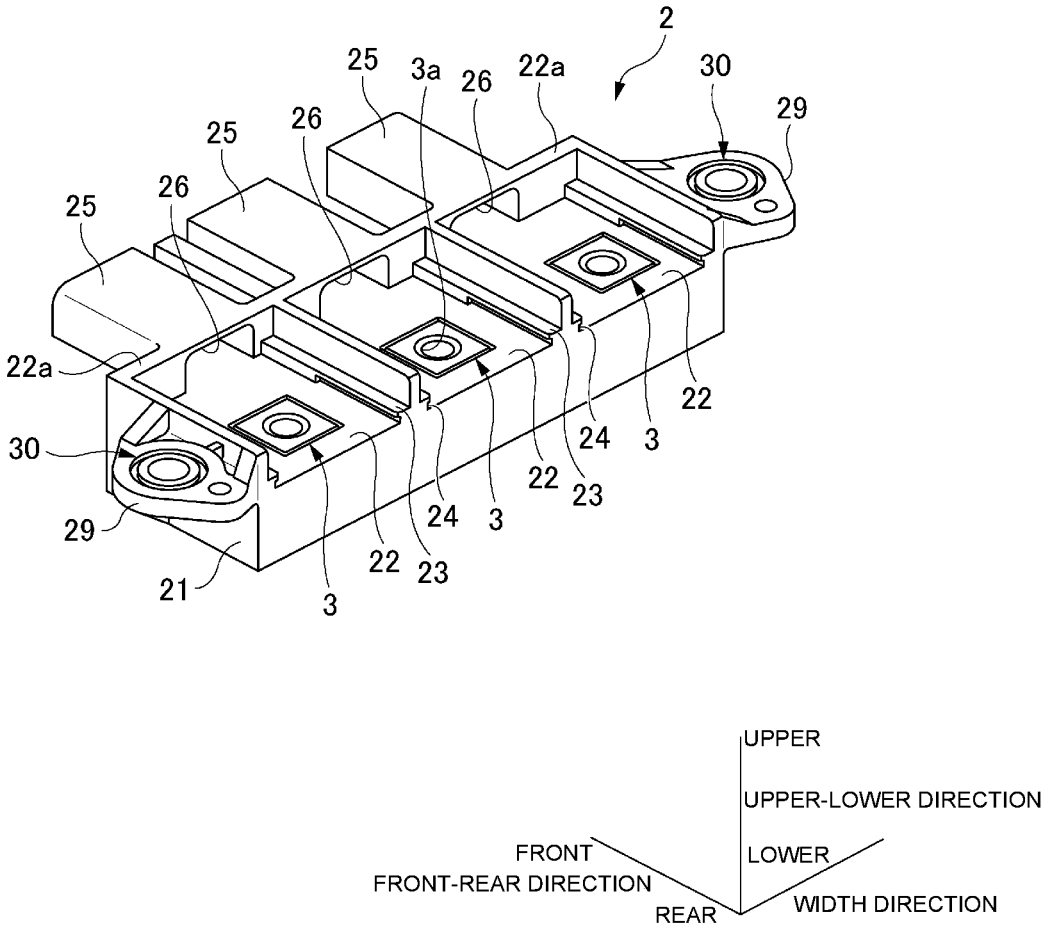
FIG. 5 is a perspective view of the electrical connection component shown in FIG. 1 as viewed from a rear side (however, the bus bars are not shown).

First, the nut 3 will be described. The nut 3 functions as a part of a component to be used when the terminal 6 is fastened and fixed to the bus bar 4 of the terminal block 1. In this example, the nut 3 is a metal component formed by casting, forging or the like. As shown in FIGS. 2 to 3 and 5, the nut 3 has a rectangular contour shape as viewed from an axial direction of the nut 3, and a bolt fastening hole 3*a* (a female screw) penetrating in the axial direction is formed in a central portion of the nut 3. A shaft portion 51 (a male screw) of a bolt 5 (see FIG. 1) is attached to the bolt fastening hole 3*a*.

Next, the bus bar 4 will be described. The bus bar 4 functions to electrically connect the terminal 6 and the mating connector 8. As shown in FIGS. 2 and 3, the bus bar 4 includes a wide portion 11, a female terminal portion 12, and a press-fitting portion 13 connecting the wide portion 11 and the female terminal portion 12. The bus bar 4 is formed by performing press process, bending process or the like on a metal plate. Width dimensions of the female terminal portion 12 and the press-fitting portion 13 are substantially the same, and a width dimension of the wide portion 11 is larger than the width dimensions of the female terminal portion 12 and the press-fitting portion 13.

The wide portion 11 has a substantially rectangular flat plate shape, and a through hole 14 penetrating in a plate thickness direction is formed at a predetermined position of the wide portion 11. The wide portion 11 functions as a portion where the terminal 6 is placed and connected. The shaft portion 51 of the bolt 5 is inserted into the through hole 14.

The female terminal portion 12 has a rectangular tubular shape penetrating in the front-rear direction. The female terminal portion 12 functions as a portion where a mating terminal (a male terminal) (not shown) belonging to the mating connector 8 is inserted and connected.

The press-fitting portion 13 has a belt-like flat plate shape extending in the front-rear direction, and connects the wide portion 11 and a bottom wall portion of the female terminal portion 12 (a flat plate-shaped portion of the rectangular tubular shape positioned on a lower side) without a step in the front-rear direction. Protrusions 15 protruding outward in the width direction are formed on both end surfaces of the press-fitting portion 13 in the width direction. When the bus bar 4 is inserted into a through hole 26 (see FIG. 1) described later of the housing 2, the protrusions 15 function as portions that come into pressure-contact with an inner wall surface of the through hole 26 to fix the bus bar 4.

In this example, as shown in FIGS. 1 to 5, three bus bars 4 are disposed side by side in the width direction for one terminal block 1. The three bus bars 4 differ in a position of the through hole 14 in the wide portion 11 and a position of the wide portion 11 in the width direction where the press-fitting portion 13 is connected depending on a position where the bus bars 4 are disposed.

Next, the housing 2 will be described. The housing 2 is a resin molded product, and includes a main body portion 21 having a substantially rectangular parallelepiped shape extending in the width direction as shown in FIGS. 1 to 5. Three bus bar accommodation portions 22 for accommodating the three bus bars 4 are recessed side by side in the width direction on an upper surface of the main body portion 21. Each bus bar accommodation portion 22 is a rectangular recess that is recessed downward and opened rearward and upward.

Figure 4:
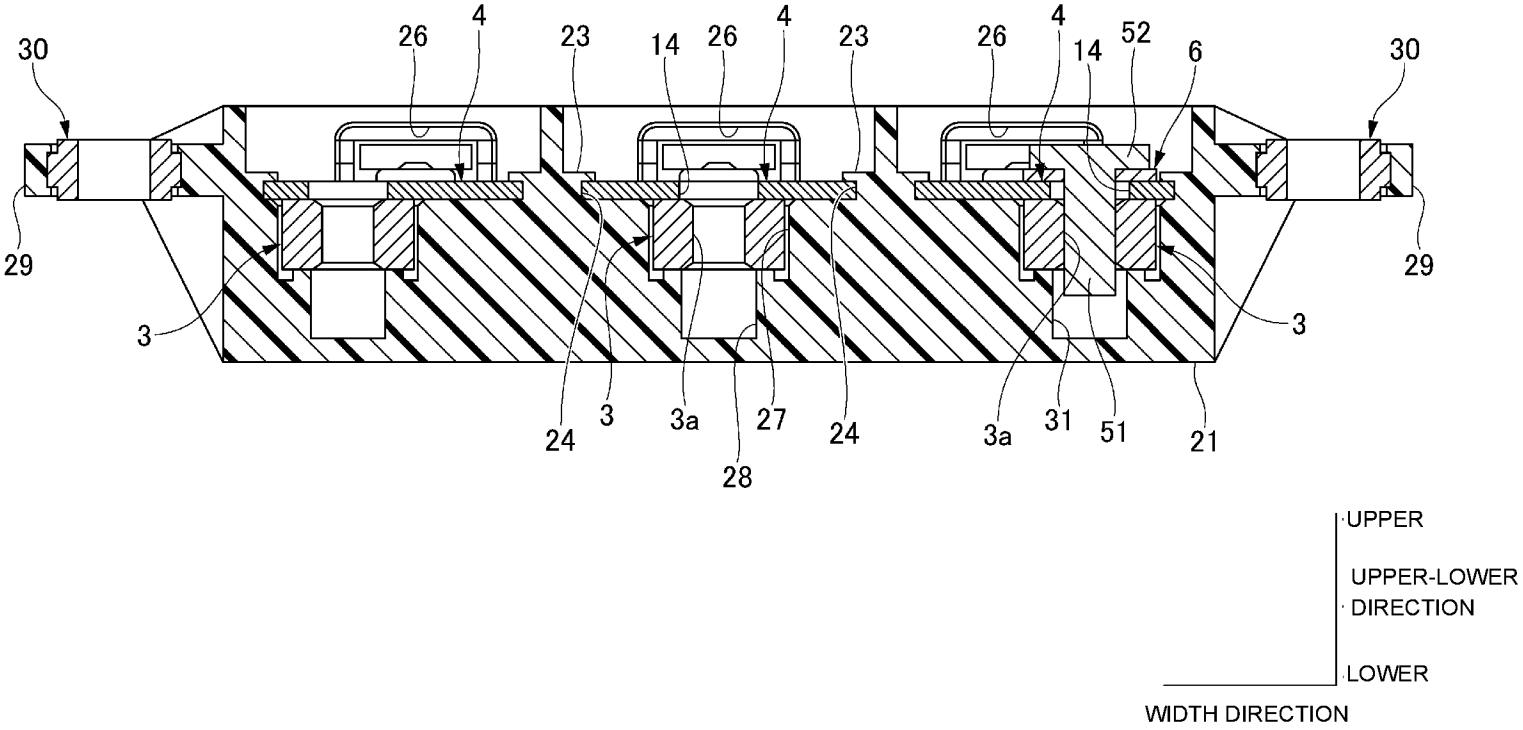
FIG. 4 is a cross-sectional view taken along a line A-A of FIG. 3.

A pair of ribs 23 protruding inward in the width direction and extending in the front-rear direction are formed on inner side surfaces of a pair of side walls extending in the front-rear direction to define both widthwise edges of each bus bar accommodation portion 22 (see FIGS. 1 to 5). As a result, as shown in FIGS. 2 and 4 to 5, a pair of grooves 24 recessed outward in the width direction and extending in the front-rear direction are defined between the pair of ribs 23 and a bottom surface (a lower surface) of the bus bar accommodation portion 22 on the inner side surfaces of the pair of side walls of each bus bar accommodation portion 22. When the bus bar 4 is accommodated in the bus bar accommodation portion 22A, a pair of side edge portions of the wide portion 11 of the bus bar 4 extending in the front-rear direction are inserted into the pair of grooves 24.

Three connector portions 25 protrude forward from a front wall 22*a* extending in the width direction to define front edges of the three bus bar accommodation portions 22, so as to be side by side in the width direction corresponding to the three bus bar accommodation portions 22. When the terminal block 1 and the mating connector 8 are connected, the three connector portions 25 are inserted into three connector accommodation holes (not shown) formed on a rear end surface of the mating connector 8.

The through hole 26 penetrating in the front-rear direction is formed inside each connector portion 25 (see FIGS. 1 to 5). The through hole 26 of each connector portion 25 communicates with the corresponding bus bar accommodation portion 22 in the front-rear direction, and a bottom surface (a lower face) of the through hole 26 is continuous with the bottom surface of the bus bar accommodation portion 22 without a step. When the bus bar 4 is accommodated in the bus bar accommodation portion 22, the female terminal portion 12 and the press-fitting portion 13 of the bus bar 4 are inserted into the through hole 26.

As shown in FIGS. 3 and 4, the press-fitting groove 27 for press-fitting the nut 3 is formed on the bottom surface of each bus bar accommodation portion 22. Each press-fitting groove 27 is formed at a predetermined position on the bottom surface of the corresponding bus bar accommodation portion 22 such that the bolt fastening hole 3*a* of the nut 3 press-fitted into the press-fitting groove 27 and the through hole 14 of the bus bar 4 placed on the bus bar accommodation portion 22 are coaxially positioned.

Each press-fitting groove 27 has a rectangular contour shape corresponding to the contour shape of the nut 3 as viewed in the upper-lower direction (see FIGS. 2 to 3 and 5), and is a recess defined by four inner side surfaces and an inner bottom surface and recessed downward. A clearance groove 28 for allowing entry of a tip end portion of the shaft portion 51 of the bolt 5 is formed so as to be recessed downward at a central position of the inner bottom surface as viewed in the upper-lower direction (see FIG. 4). When the nut 3 is press-fitted into the press-fitting groove 27, the nut 3 is accommodated in the press-fitting groove 27 in a non-rotatable manner.

As shown in FIGS. 1 to 5, a pair of attachment portions 29 used to fix the housing 2 to an attachment target (for example, a vehicle) are integrally formed on both end surfaces of the main body portion 21 in the width direction so as to protrude to both sides in the width direction. A cylindrical metal collar 30 is attached to each attachment portion 29. A pair of bolts (not shown) inserted into the pair of collars 30 are fastened and fixed to the attachment target, whereby the terminal block 1 is fixed to the attachment target.

Figure 6:
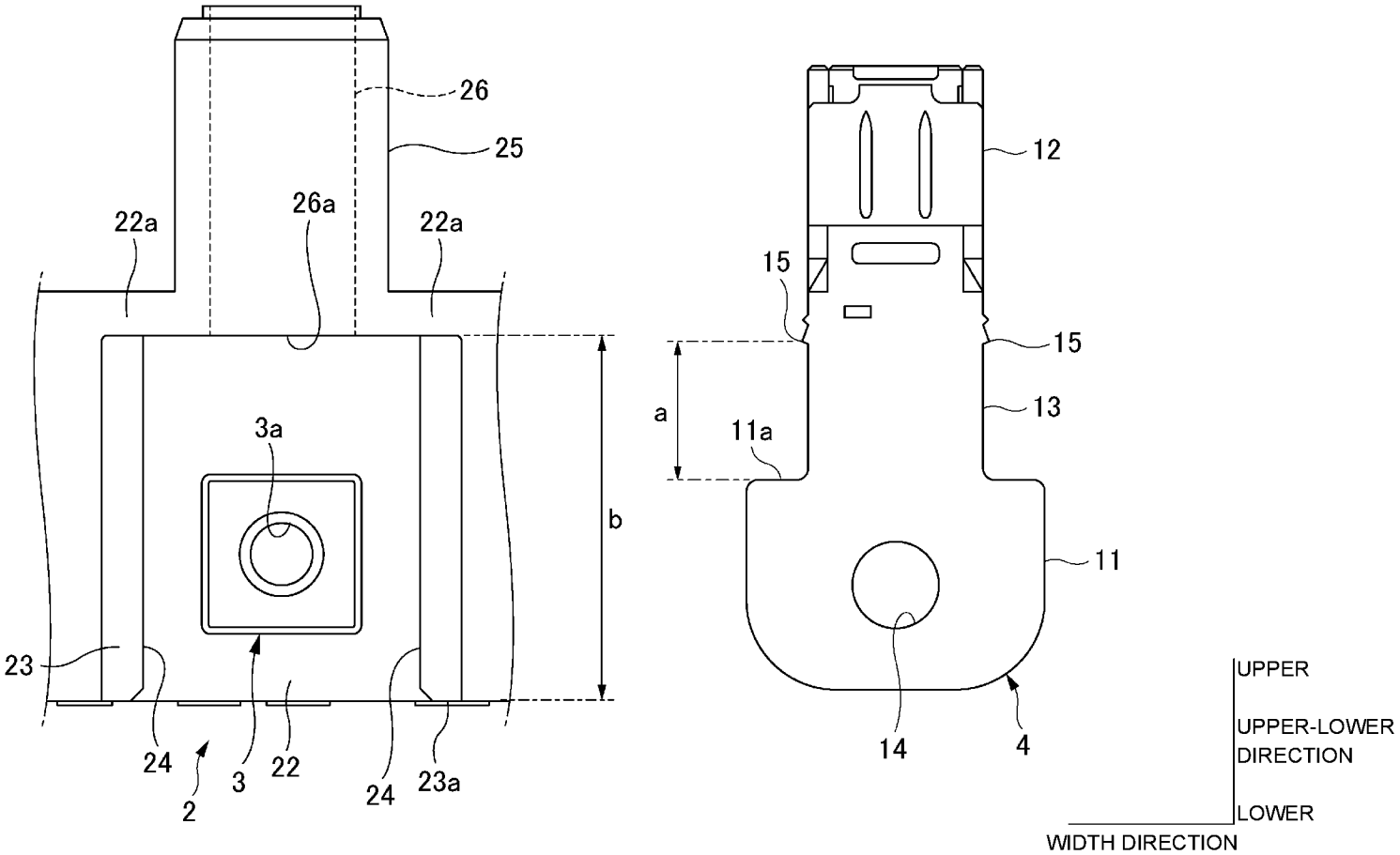
FIG. 6 is a view for explaining a magnitude relationship between a distance a and a distance b.

As shown in FIG. 6, a distance b in the front-rear direction from the front wall 22*a* of the bus bar accommodation portion 22 to a rear end portion 23*a* of the rib 23 in the housing 2 is equal to or larger than a distance a in the front-rear direction from the protrusion 15 to a front end portion 11*a* of the wide portion 11 in the bus bar 4 (b≥a). An action due to a magnitude relationship (b≥a) between the distance a and the distance b will be described later. The components constituting the terminal block 1 have been described above.

Next, procedures for assembling the terminal block 1 will be described. First, the nut 3 is press-fitted into each press-fitting groove 27 of the housing 2. This press-fitting is continued until a bottom surface of the nut 3 comes into contact with the inner bottom surface of the press-fitting groove 27 (see FIG. 4).

After the press-fitting of the nut 3 into each press-fitting groove 27 is completed, the corresponding bus bar 4 is then accommodated in each bus bar accommodation portion 22 of the housing 2. Therefore, the bus bar 4 is pushed forward into the main body portion 21, from a state in which the bus bar 4 is placed on the bottom surface of the bus bar accommodation portion 22 such that the wide portion 11 of the bus bar 4 protrudes rearward from a rear end of the main body portion 21, and the female terminal portion 12 and the press-fitting portion 13 of the bus bar 4 cover the nut 3 press-fitted into the press-fitting groove 27.

When the bus bar 4 is pushed forward, the bus bar 4 slides forward while rubbing on the bottom surface of the bus bar accommodation portion 22, the female terminal portion 12 and the press-fitting portion 13 are inserted into the through hole 26 of the connector portion 25 in this order, and the pair of side edge portions of the wide portion 11 are inserted into the pair of grooves 24 of the bus bar accommodation portion 22.

Figure 7:
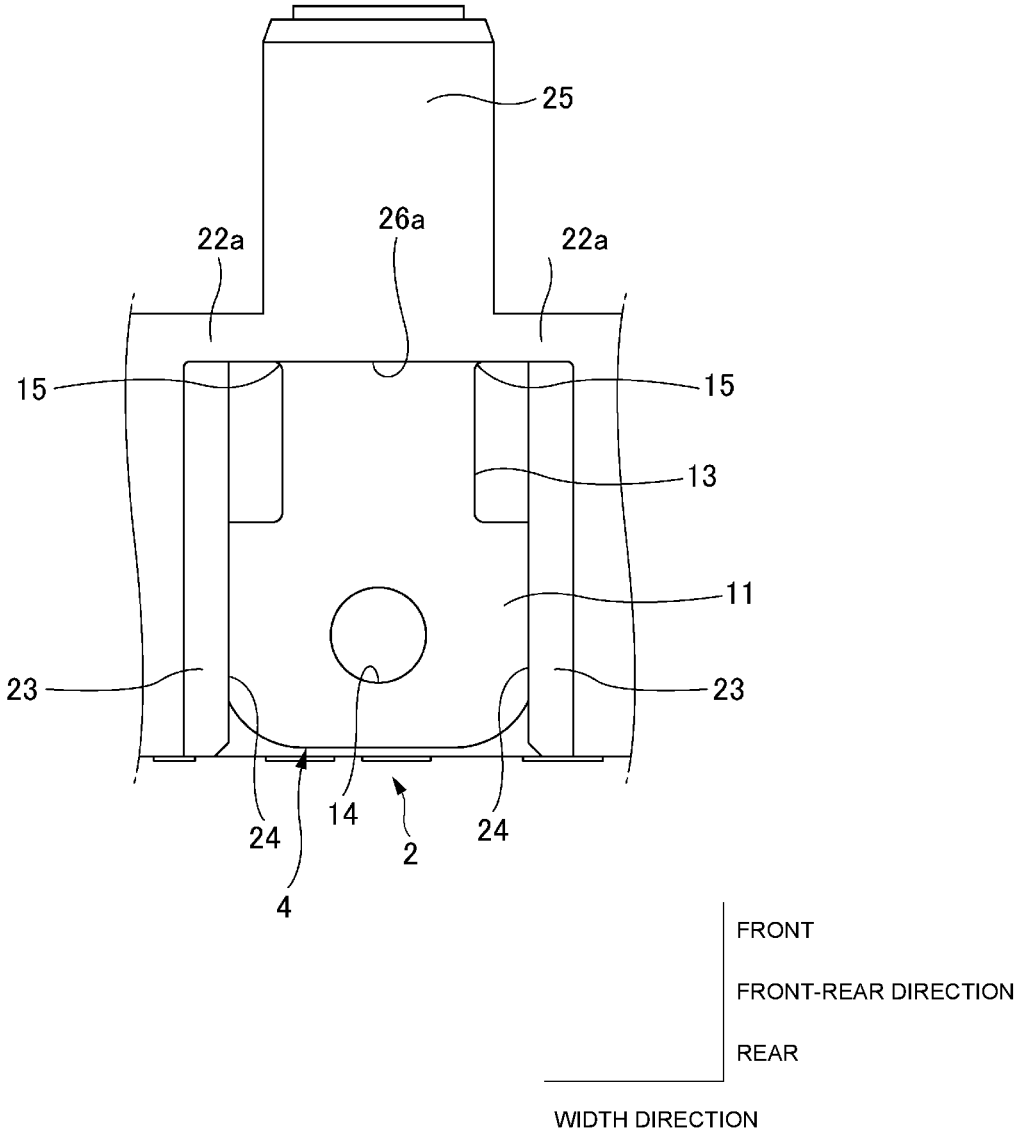
FIG. 7 is a view for explaining a positional relationship between the bus bar and the housing at a time point when press-fitting of the bus bar into the housing is started.

As insertion of the press-fitting portion 13 into the through hole 26 progresses, as shown in FIG. 7, when the pair of protrusions 15 of the press-fitting portion 13 reach a rear end portion 26*a* of the through hole 26, the pair of protrusions 15 thereafter rub against the inner wall surface of the through hole 26 while being in pressure-contact therewith. That is, a time point when the pair of protrusions 15 are positioned at the rear end portion 26*a* of the through hole 26 is a time point when press-fitting of the bus bar 4 into the through hole 26 (the connector portion 25) is started.

At the press-fitting start time point (that is, at the time point when the pair of protrusions 15 are positioned at the rear end portion 26*a* of the through hole 26), the pair of side edge portions of the wide portion 11 of the bus bar 4 are already held and covered by the pair of ribs 23 of the bus bar accommodation portion 22, as shown in FIG. 7, due to the magnitude relationship (b≥a, see FIG. 6) between the distance a and the distance b described above.

Therefore, even when a direction of an external force applied to the bus bar 4 for press-fitting the bus bar 4 is not appropriate (specifically, when the direction is slightly tilted with respect to a forward direction), a posture of the bus bar 4 is less likely to be deviated from an original press-fitting posture. Therefore, even in such a case, unintended deformation of the bus bar 4 is prevented. Further, deformation of the bus bar 4 in a direction away from the bottom surface of the bus bar accommodation portion 22, which is a typical deformation pattern of the bus bar 4, is prevented by the pair of ribs 23.

When the bus bar 4 reaches a predetermined position in the front-rear direction with respect to the main body portion 21 as the press-fitting of the bus bar 4 into the through hole 26 progresses, accommodation of the bus bar 4 into the bus bar accommodation portion 22 is completed. In a state in which the accommodation of the bus bar 4 into the bus bar accommodation portion 22 is completed, the wide portion 11 of the bus bar 4 covers the nut 3, the through hole 14 of the wide portion 11 and the bolt fastening hole 3*a* of the nut 3 are coaxially positioned, and the female terminal portion 12 of the bus bar 4 is positioned in vicinity of a front end opening of the through hole 26 provided in the through hole 26 of the connector portion 25 (see also FIGS. 1 and 3).

Since the pair of protrusions 15 are in pressure-contact with the inner wall surface of the through hole 26, the bus bar 4 can be prevented from coming off rearward. In addition, since the pair of side edge portions of the wide portion 11 are inserted into the pair of grooves 24 of the bus bar accommodation portion 22, the bus bar 4 can also be prevented from floating upward. Thereby, the bus bar 4 is securely fixed at the predetermined position of the bus bar accommodation portion 22.

As describe above, assembly of the terminal block 1 is completed. The three terminals 6 (see FIG. 1) provided at the ends of the three electric wires 7 are respectively connected to the wide portions 11 of the three bus bars 4 of the terminal block 1 that has been assembled. In order to connect the terminal 6 to the wide portion 11, in a state in which the terminal 6 is placed on the wide portion 11, and the shaft portion 51 of the bolt 5 extending from a head portion 52 of the bolt 5 is inserted into the through hole 6*a* of the terminal 6 and the through hole 14 of the bus bar 4 in this order from above, the shaft portion 51 of the bolt 5 is fastened to the bolt fastening hole 3*a* of the nut 3 with a predetermined torque. Thereby, the bolt 5 is fastened and fixed to the nut 3, and the terminal 6 is sandwiched between the nut 3 and the head portion 52 of the bolt 5. As a result, the terminal 6 is fixed to the wide portion 11, and the terminal 6 is electrically connected to the wide portion 11.

Further, the mating connector 8 (see FIG. 1) is connected to the three connector portions 25 of terminal block 1 that has been assembled. In order to connect the mating connector 8 to the connector portions 25, the connector portions 25 are inserted into the three connector accommodation holes (not shown) formed in the mating connector 8 to be fitted. Thereby, the mating terminal (the male terminal, not shown) positioned inside the connector accommodation hole is inserted into the female terminal portion 12 of the bus bar 4 positioned in the through hole 26 of the connector portion 25. As a result, the mating terminal is electrically connected to the female terminal portion 12. As described above, the terminal block 1 can function as the relay connector that electrically connects the plurality of terminals 6 respectively provided at the ends of the plurality of electric wires 7 and the mating connector 8 via the bus bars 4.

Functions and Effects

As described above, according to the terminal block (the electrical connection component) 1 according to the present embodiment, when the bus bar 4 is press-fitted into the through hole 26 of the housing 2, at least a part (the wide portion 11) of the bus bar 4 is restricted from being displaced in a direction different from a press-fitting direction by the pair of ribs 23 of the housing 2 during a period from the press-fitting start time point to a press-fitting completion time point. Thereby, even when the direction of the external force for press-fitting applied to the bus bar 4 is not appropriate (for example, when the direction is slightly tilted with respect to the original press-fitting direction), the posture and position of the bus bar 4 are less likely to be deviated from the original posture and position at the time of press-fitting due to an action of the pair of ribs 23. Therefore, even in such a case, unintended deformation of the bus bar 4 is prevented. Accordingly, in the terminal block 1 having the present configuration, deformation of the bus bar 4 when the bus bar 4 is attached to the housing 2 by being press-fitted can be prevented.

Further, the distance b in the press-fitting direction from a near-side end portion (26*a*) of the through hole 26 in the press-fitting direction to near-side end portions (23*a*) of the pair of ribs 23 in the press-fitting direction is equal to or larger than the distance a in the press-fitting direction from the protrusion 15 to a far-side end portion (11*a*) of the wide portion 11 in the press-fitting direction (b≥a). Thereby, at a time point when the press-fitting portion 13 of the bus bar 4 is inserted into the through hole 26 (that is, the through hole 26) and the protrusion 15 protruding from the press-fitting portion 13 starts to come into contact with an inner peripheral surface of the through hole 26 (that is, the press-fitting start time point), the wide portion 11 of the bus bar 4 can come into contact with the pair of rib-shaped ribs 23 of the housing 2. In other words, the pair of ribs 23 restrict the wide portion 11 from being displaced in the direction different from the press-fitting direction at least at the press-fitting start time point. As a result, unintended deformation of the bus bar 4 at the time of press-fitting is prevented.

Further, the pair of rib-shaped ribs 23 are provided in the accommodation portion of the housing 2. Thereby, the pair of ribs 23 can come into contact with both ends of the wide portion 11 of the bus bar 4 in the width direction. Therefore, not only deformation of the bus bar 4 that warps in a direction away from the bottom surface of the bus bar accommodation portion 22, but also deformation of the bus bar 4 that is twisted as a whole is prevented.

Further, the wide portion 11 of the bus bar 4 is inserted into gaps (the grooves 24) between the bottom surface of the bus bar accommodation portion 22 and the pair of ribs 23. Thereby, in addition to preventing the deformation of the bus bar 4, the bus bar 4 can be easily guided toward the through hole 26.

Other Embodiments

The present disclosure is not limited to the above embodiment and various modifications can be adopted within the scope of the present disclosure. For example, the present disclosure is not limited to the above-described embodiment, and may be appropriately modified, improved or the like. In addition, the material, shape, size, number, arrangement position and the like of each component in the above-described embodiment are optional and are not limited as long as the present disclosure can be achieved.

In the above embodiment, the pair of ribs 23 are formed in the bus bar accommodation portion 22. On the other hand, only one rib 23 of the pair of ribs 23 may be formed in the bus bar accommodation portion 22. In this case, when the bus bar 4 is accommodated in the bus bar accommodation portion 22, only one side edge portion of the pair of side edge portions of the wide portion 11 of the bus bar 4 is inserted into the groove 24 defined between the one rib 23 and the bottom surface of the bus bar accommodation portion 22.

Further, in the above embodiment, the pair of ribs 23 maintains a state of covering both end portions of the wide portion 11 of the bus bar 4 even after the press-fitting of the bus bar 4 is completed. However, as long as the ribs 23 restrict unintended displacement of the wide portion 11 during the period from the press-fitting start time point to the press-fitting completion time point of the bus bar 4, the ribs 23 do not necessarily need to cover the wide portion 11 after the press-fitting completion time point. For example, the ribs 23 and the wide portion 11 may have lengths and shapes in the press-fitting direction such that the wide portion 11 comes out of the grooves 24 between the ribs 23 and the bottom surface at the same time as the press-fitting is completed.

Here, features of the terminal block 1 according to the embodiment of the present disclosure described above will be briefly summarized and listed in the following [1] to [4].

[1] An electrical connection component (1) includes: a conductor (4); and a housing (2) into which the conductor (4) is press-fitted.

The housing (2) includes a press-fitted portion (25) having a hollow shape and into which the conductor (4) is press-fitted in a press-fitting direction, and a restriction portion (23) provided at a position different from a position of the press-fitted portion (25), the restriction portion (23) restricting at least a part of the conductor (4) from being displaced in a direction different from the press-fitting direction from a time point when press-fitting of the conductor (4) into the press-fitted portion (25) is started to a time point w % ben the press-fitting is completed.

[2] In the electrical connection component (1) according to [1], the housing (2) includes an accommodation portion (22) having a recessed shape and opened on a near side in the press-fitting direction;

the press-fitted portion (25) defines a through hole (26) communicating with the accommodation portion (22) in the press-fitting direction and having a shape extending toward a far side in the press-fitting direction, the far side being opposite to the near side:

the restriction portion (23) has a rib-like shape protruding from a side wall of the accommodation portion (22) in a width direction intersecting the press-fitting direction and extending along the press-fitting direction;

the conductor (4) includes a press-fitting portion (13) extending in the press-fitting direction, a protrusion (15) protruding from the press-fitting portion (13) in the width direction and a wide portion (11) having a dimension in the width direction larger than that of the press-fitting portion (13), and the conductor (4) is press-fitted into the press-fitted portion (25) by the protrusion (15) coming into pressure-contact with an inner peripheral surface of the through hole (26); and a distance (b) in the press-fitting direction from a near-side end portion (26*a*) of the through hole (26) in the press-fitting direction to a near-side end portion (23*a*) of the restriction portion (23) in the press-fitting direction is equal to or larger than a distance (a) in the press-fitting direction from the protrusion (15) to a far-side end portion (11*a*) of the wide portion (11) in the press-fitting direction.

[3] In the electrical connection component (1) according to [2], the restriction portion (23) has a pair of rib-like shapes protruding from a pair of side walls of the accommodation portion (22) so as to face each other such that the wide portion (11) of the conductor (4) is sandwiched by the pair of rib-like shapes, the pair of side walls facing each other.

[4] In the electrical connection component (1) according to [2] or [3], the restriction portion (23) receives the wide portion (11) of the conductor (4) in a gap (24) between the restriction portion (23) and a bottom surface of the accommodation portion (22) to restrict the wide portion (11) from being displaced in the direction different from the press-fitting direction.

According to the electrical connection component having a configuration of [1], when the conductor is press-fitted into the press-fitted portion of the housing, at least a part of the conductor is restricted from being displaced in the direction different from the press-fitting direction by the restriction portion of the housing during a period from the press-fitting start time point to the press-fitting completion time point. Thereby, even when a direction of an external force for press-fitting applied to the conductor is not appropriate (for example, when the direction is slightly tilted with respect to the original press-fitting direction), a posture and a position of the conductor are less likely to be deviated from the original posture and position at the time of press-fitting due to an action of the restriction portion. Therefore, even in such a case, unintended deformation of the conductor is prevented. Accordingly, in the electrical connection component having the present configuration, deformation of the conductor when the conductor is attached to the housing by being press-fitted can be prevented.

According to the electrical connection component having a configuration of [2], the distance in the press-fitting direction from the near-side end portion of the through hole in the press-fitting direction to the near-side end portion of the restriction portion in the press-fitting direction (for example, a distance b in FIG. 6) is equal to or larger than the distance in the press-fitting direction from the protrusion to the far-side end portion of the wide portion in the press-fitting direction (for example, a distance a in FIG. 6). Thereby, at a time point when the press-fitting portion of the conductor is inserted into the through hole (that is, the press-fitted portion) and the protrusion protruding from the press-fitting portion starts to come into contact with an inner peripheral surface of the through hole (that is, at the press-fitting start time point), the wide portion of the conductor can come into contact with the rib-shaped restriction portion of the housing. In other words, the restriction portion restricts the wide portion from being displaced in the direction different from the press-fitting direction at least at the press-fitting start time point. As a result, the unintended deformation of the conductor during press-fitting is prevented.

According to the electrical connection component having a configuration of [3]. the pair of rib-shaped restriction portions are provided in the accommodation portion of the housing. Thereby, the pair of restriction portions can come into contact with both ends of the wide portion of the conductor in the width direction. Therefore, not only deformation of the conductor that warps in a direction away from the bottom surface of the accommodation portion, but also deformation of the conductor that is twisted as a whole is prevented.

According to the electrical connection component having a configuration of [4], the wide portion of the conductor is inserted into the gap between the bottom surface of the accommodation portion and the restriction portions. Accordingly, in addition to preventing the deformation of the conductor, the conductor can be easily guided toward the press-fitted portion.

What is claimed is:

1. An electrical connection component comprising:

a conductor; and a housing into which the conductor is press-fitted, wherein the housing includes:

a press-fitted portion having a hollow shape and into which the conductor is press-fitted in a press-fitting direction; and a restriction portion provided at a position different from a position of the press-fitted portion, the restriction portion restricting at least a part of the conductor from being displaced in a direction different from the press-fitting direction from a time point when press-fitting of the conductor into the press-fitted portion is started to a time point when the press-fitting is completed, wherein the conductor includes an end surface, a protrusion protruding from the end surface in a width direction that intersects the press-fitting direction, and a wide portion spaced away from the protrusion, wherein the conductor is press-fitted into the press-fitted portion by the protrusion coming into pressure-contact with an inner peripheral surface of the press-fitted portion, wherein the conductor has a first width measured at the protrusion in the width direction and a second width measured at the wide portion in the width direction, and the second width is greater than the first width, wherein the housing includes an accommodation portion having a recessed shape and opened on a near side in the press-fitting direction;

wherein the inner peripheral surface of the press-fitted portion defines a through hole communicating with the accommodation portion in the press-fitting direction and having a shape extending toward a far side in the press-fitting direction, the far side being opposite to the near side;

wherein the restriction portion has a rib-shaped portion protruding from a side wall of the accommodation portion in the width direction and extending along the press-fitting direction;

wherein the conductor includes a press-fitting portion extending in the press-fitting direction from the wide portion;

wherein the press-fitting portion includes the end surface, and wherein a distance in the press-fitting direction from a near-side end portion of the through hole in the press-fitting direction to a near-side end portion of the restriction portion in the press-fitting direction is equal to or larger than a distance in the press-fitting direction from the protrusion to a far-side end portion of the wide portion in the press-fitting direction.

2. The electrical connection component according to claim 1, wherein the restriction portion has a pair of rib-shaped portions protruding from a pair of side walls of the accommodation portion so as to face each other such that the wide portion of the conductor is sandwiched by the pair of rib-shaped portions, the pair of side walls facing each other.

3. The electrical connection component according to claim 1, wherein the restriction portion receives the wide portion of the conductor in a gap between the restriction portion and a bottom surface of the accommodation portion to restrict the wide portion from being displaced in the direction different from the press-fitting direction.

4. An electrical connection component comprising:

a conductor; and a housing into which the conductor is press-fitted, wherein the housing includes:

a press-fitted portion having a hollow shape and into which the conductor is press-fitted in a press-fitting direction; and a restriction portion provided at a position different from a position of the press-fitted portion, wherein the conductor includes an end surface, a protrusion protruding from the end surface in a width direction that intersects the press-fitting direction, and a wide portion spaced away from the protrusion, wherein the conductor has a first width measured at the protrusion in the width direction and a second width measured at the wide portion in the width direction, and the second width is greater than the first width, wherein the housing includes an accommodation portion having a recessed shape and opened on a near side in the press-fitting direction;

wherein the inner peripheral surface of the press-fitted portion defines a through hole communicating with the accommodation portion in the press-fitting direction and having a shape extending toward a far side in the press-fitting direction, the far side being opposite to the near side;

wherein the restriction portion has a rib-shaped portion protruding from a side wall of the accommodation portion in the width direction and extending along the press-fitting direction;

wherein the conductor includes a press-fitting portion extending in the press-fitting direction from the wide portion;

wherein the press-fitting portion includes the end surface, and wherein a distance in the press-fitting direction from a near-side end portion of the through hole in the press-fitting direction to a near-side end portion of the restriction portion in the press-fitting direction is equal to or larger than a distance in the press-fitting direction from the protrusion to a far-side end portion of the wide portion in the press-fitting direction.

5. The electrical connection component according to claim 4, wherein the restriction portion has a pair of rib-shaped portions protruding from a pair of side walls of the accommodation portion so as to face each other such that the wide portion of the conductor is sandwiched by the pair of rib-shaped portions, the pair of side walls facing each other.

6. The electrical connection component according to claim 4, wherein the restriction portion receives the wide portion of the conductor in a gap between the restriction portion and a bottom surface of the accommodation portion to restrict the wide portion from being displaced in a direction different from the press-fitting direction.

* * * * *